US011506418B1

(12) United States Patent
Mosiman et al.

(10) Patent No.: US 11,506,418 B1
(45) Date of Patent: Nov. 22, 2022

(54) VENT EXTENDER

(71) Applicant: Spectrum Products LLC, Mesa, AZ (US)

(72) Inventors: Renee Mosiman, Mesa, AZ (US); Michael Mosiman, Mesa, AZ (US)

( * ) Notice: Subject to any disclaimer, the term of this patent is extended or adjusted under 35 U.S.C. 154(b) by 0 days.

(21) Appl. No.: 17/652,230

(22) Filed: Feb. 23, 2022

Related U.S. Application Data

(63) Continuation of application No. 17/455,065, filed on Nov. 16, 2021.

(60) Provisional application No. 63/119,947, filed on Dec. 1, 2020.

(51) Int. Cl.
*F24F 13/08* (2006.01)

(52) U.S. Cl.
CPC ..... *F24F 13/084* (2013.01)

(58) Field of Classification Search
CPC ..... F24F 13/084
USPC ..... 454/307
See application file for complete search history.

(56) References Cited

U.S. PATENT DOCUMENTS

| | | | |
|---|---|---|---|
| D192,036 | S | 1/1962 | Raymond |
| 3,403,809 | A | 10/1968 | Kennedy et al. |
| D256,082 | S | 7/1980 | Colato et al. |
| 4,349,124 | A | 9/1982 | Faller |
| D268,981 | S | 5/1983 | Monson |
| 4,576,331 | A | 3/1986 | Harwell |
| D300,777 | S | 4/1989 | Bales et al. |
| D315,206 | S | 3/1991 | Sisk |
| D321,743 | S | 11/1991 | Logue et al. |
| D327,497 | S | 6/1992 | Szablak et al. |
| D338,662 | S | 8/1993 | Sharp |
| D362,154 | S | 9/1995 | Pusateri |
| D363,410 | S | 10/1995 | Hazen |
| D374,927 | S | 10/1996 | Chabot |

(Continued)

FOREIGN PATENT DOCUMENTS

| | | | |
|---|---|---|---|
| CA | 2542253 | A1 | 9/2007 |
| CA | 2775519 | A1 | 10/2012 |

(Continued)

OTHER PUBLICATIONS

Ventilaider Magnetic Air Vent Extender for Under Furniture, first available Apr. 7, 2020[online], https://www.amazon.com/Ventilaider-Magnetic-Extender-Furniture-Registers/dp/B086TWZ97Y (Year: 2020).*

(Continued)

*Primary Examiner* — Allen R. B. Schult
(74) *Attorney, Agent, or Firm* — Adam R. Stephenson, Ltd.

(57) ABSTRACT

Implementations of vent extenders may include a first portion including a back wall, a first sidewall, and a second sidewall and a second portion including a first sidewall and a second sidewall. The second portion may be configured to extendably couple to the first portion. The vent extender may also include a pocket formed within the first portion and including a first pocket sidewall, a second pocket sidewall, a third pocket sidewall opposite the second pocket sidewall, an opening opposite the first pocket sidewall, and a base. The vent extender may also include a magnet coupled to the base of the pocket. The first pocket sidewall may be directly coupled to both of the second pocket sidewall and the third pocket sidewall. The magnet may be configured to secure the vent extender to a vent register.

12 Claims, 7 Drawing Sheets

(56) References Cited

U.S. PATENT DOCUMENTS

| | | | | |
|---|---|---|---|---|
| D376,007 | S | 11/1996 | Thomas | |
| D432,226 | S | 10/2000 | Orendorff | |
| D462,436 | S | 9/2002 | Bennett et al. | |
| D463,202 | S | 9/2002 | Smith | |
| D471,397 | S | 3/2003 | Wright | |
| D552,378 | S | 10/2007 | Hussaini et al. | |
| D610,405 | S | 2/2010 | McConnell | |
| D654,162 | S | 2/2012 | Sykes | |
| D666,285 | S | 8/2012 | Schrad et al. | |
| 9,644,859 | B2 * | 5/2017 | Migliore | F24F 13/065 |
| D828,536 | S | 9/2018 | Couto | |
| D930,089 | S | 9/2021 | Oblamski et al. | |
| 2012/0073158 | A1 | 3/2012 | Sciallo et al. | |
| 2013/0337738 | A1 | 12/2013 | Sanderson et al. | |
| 2014/0170962 | A1 | 6/2014 | Carter | |
| 2014/0260105 | A1 | 9/2014 | Smith | |
| 2017/0226744 | A1 | 8/2017 | Platts | |
| 2017/0268720 | A1 | 9/2017 | Rogers | |
| 2019/0072294 | A1 * | 3/2019 | Mazzuca | F24F 13/084 |

FOREIGN PATENT DOCUMENTS

| | | | |
|---|---|---|---|
| CN | 104727114 | B | 1/2017 |
| KR | 20170124740 | A | 11/2017 |
| ZA | 200908864 | B | 9/2010 |

OTHER PUBLICATIONS

Airconditioneri, Adjustable Vent Extender Heat Deflector Air Conditioner Register Floor Furnace, Retrieved from he Internet: hllps://plastic.airconditioneri.com/hdfl-snowman-snow-gauge-yard-stake-metal-frosty.html?product_id=£/SITPzMMbxORQ [retrieved Nov. 30, 2020], 16 pages.

Fox Valley Traders, Furnace Vent Extender, Air Deflector for Floor Registers, Retrieved from the Internet: https:/WWW.walmart.com/ip/Furnace-Vent-Extender-Air-Deflector-for-Floor-Registers/ 37516035 [retrieved Nov. 30, 2020 ], 11 pages.

Deflecto Furniture Deflector Air Vent Extender, first available Jul. 27, 2017[online], [site visited Mar. 29, 2021]. Available from internet, URL:< https://www.amazon.com/Deflecto-Fumiture-Deflector-Registers-UFAD/dp/B0749KXCZF> (Year 2017).

Miles Kimball Furnace Vent Extender, first available Jun. 22, 2012[online], [site visited Mar. 29, 2021] Available from Internet, URL:< https://www.amazon.com/Miles-Kimball-Fumace-Vent-Extender/dp/BOOA922NW2> (Year: 2012).

* cited by examiner

VENT EXTENDER

CROSS REFERENCE TO RELATED APPLICATIONS

This application is a continuation application of the earlier U.S. Utility patent application to Mosiman entitled "Vent Extender," application Ser. No. 17/455,065, filed Nov. 26, 2021, now pending, which application claims the benefit of the filing date of U.S. Provisional Patent Application 63/119,947, entitled "Vent Extender" to Mosiman which was filed on Dec. 1, 2020, the disclosures of each of which are hereby incorporated entirely herein by reference.

BACKGROUND

1. Technical Field

Aspects of this document relate generally to vent extenders.

2. Background

Vent extenders may be attached to a vent register. Airflow from the vent register, which may be heated or cooled, may pass through the vent extender.

SUMMARY

Implementations of vent extenders may include a first portion including a back wall, a first sidewall, and a second sidewall and a second portion including a first sidewall and a second sidewall. The second portion may be configured to extendably couple to the first portion. The vent extender may also include a pocket formed within the first portion and including a first pocket sidewall, a second pocket sidewall, a third pocket sidewall opposite the second pocket sidewall, an opening opposite the first pocket sidewall, and a base. The vent extender may also include a magnet coupled to the base of the pocket. The first pocket sidewall may be directly coupled to both of the second pocket sidewall and the third pocket sidewall. The magnet may be configured to secure the vent extender to a vent register.

Implementations of vent extenders may include one, all, or any of the following:

The first pocket sidewall may be parallel with the back wall.

The pocket may include less than four sidewalls.

The magnet may be configured to directly couple to the vent register.

The base may be configured to be between the magnet and the vent register when the vent extender is secured to the vent register.

The first pocket sidewall may be sloped towards a front of the vent extender, the second pocket sidewall may be sloped towards the first sidewall of the first portion, and the third pocket sidewall may be sloped towards the second sidewall of the first portion.

The first portion may include a lip directly coupled to each of the back wall, the first sidewall, and the second sidewall.

The vent extender may include an adhesive dot configured to couple the first portion to the second portion.

Implementations of vent extenders may include a back wall, a first sidewall, a second sidewall and a first pocket formed within the back wall and including a first pocket sidewall, a second pocket sidewall, a third pocket sidewall opposite the second pocket sidewall, an opening opposite the first pocket sidewall, and a base. The vent extender may also include a second pocket formed within the back wall and including a first pocket sidewall, a second pocket sidewall, a third pocket sidewall opposite the second pocket sidewall, an opening opposite the first pocket sidewall, and a base. The vent extender may also include a first magnet coupled to the base of the first pocket and a second magnet coupled to the base of the second pocket. The first magnet and the second magnets may be configured to secure the vent extender to a vent register.

Implementations of vent extenders may include one, all, or any of the following:

A width of the first pocket may taper towards the base of the first pocket and a width of the second pocket may taper towards the base of the second pocket.

Implementations of vent extenders may include a roof directly coupled to and between the first sidewall and the second sidewall. The roof may include a plurality of ridges extending therefrom.

The first magnet and the second magnet may each be configured to directly couple to the vent register.

The base of the first pocket may be configured to be between the first magnet and the vent register and the base of the second pocket may be configured to be between the second magnet and the vent register when the vent register is secured to the vent extender.

A first plane formed through the base of the first pocket and the base of the second pocket may be closer to a roof of the vent extender than a second plane formed along a bottom of the vent extender opposite the roof of the vent extender.

The first magnet and the second magnet may be neodymium magnets.

Implementations of vent extenders may include a first portion including a back wall, a first sidewall, a second sidewall, and a roof directly coupled to and between the first sidewall and the second sidewall. Implementations of vent extenders may also include a second portion including a first sidewall, a second sidewall, and a roof directly coupled to and between the first sidewall and the second sidewall. Implementations of vent extenders may also include one or more coupling mechanisms configured to extendably couple the first portion to the second portion. Implementations of vent extenders may also include a first pocket formed within the first portion and having a first pocket sidewall, a second pocket sidewall, a third pocket sidewall opposite the second pocket sidewall, an opening opposite the first pocket sidewall, and a base. Implementations of vent extenders may also include a second pocket formed within the first portion and having a first pocket sidewall, a second pocket sidewall, a third pocket sidewall opposite the second pocket sidewall, an opening opposite the first pocket sidewall, and a base. Implementations of vent extenders may include a first magnet coupled to the base of the first pocket and a second magnet coupled to the base of the second pocket. The roof of the first portion may include a plurality of ridges extending therefrom. The roof the second portion may include a plurality of ridges extending therefrom. The first magnet and the second magnets may be configured to secure the vent extender to a vent register.

Implementations of vent extenders may include one, all, or any of the following:

The first portion and the second portion may be transparent.

The plurality of ridges of the roof of the first portion may be configured to interlock with the plurality of ridges of the roof of the second portion.

Each of the first pocket and the second pocket may include less than four sidewalls.

The first sidewall of the first pocket and the second pocket may slope towards a front of the vent extender, the second sidewall of the first pocket and the second pocket may slope towards the first sidewall of the first portion, and the third sidewall of the first pocket and the second pocket may slope towards the second sidewall of the first portion.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended vent extender will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such vent extenders, and implementing components and methods, consistent with the intended operation and methods.

Figure 1:
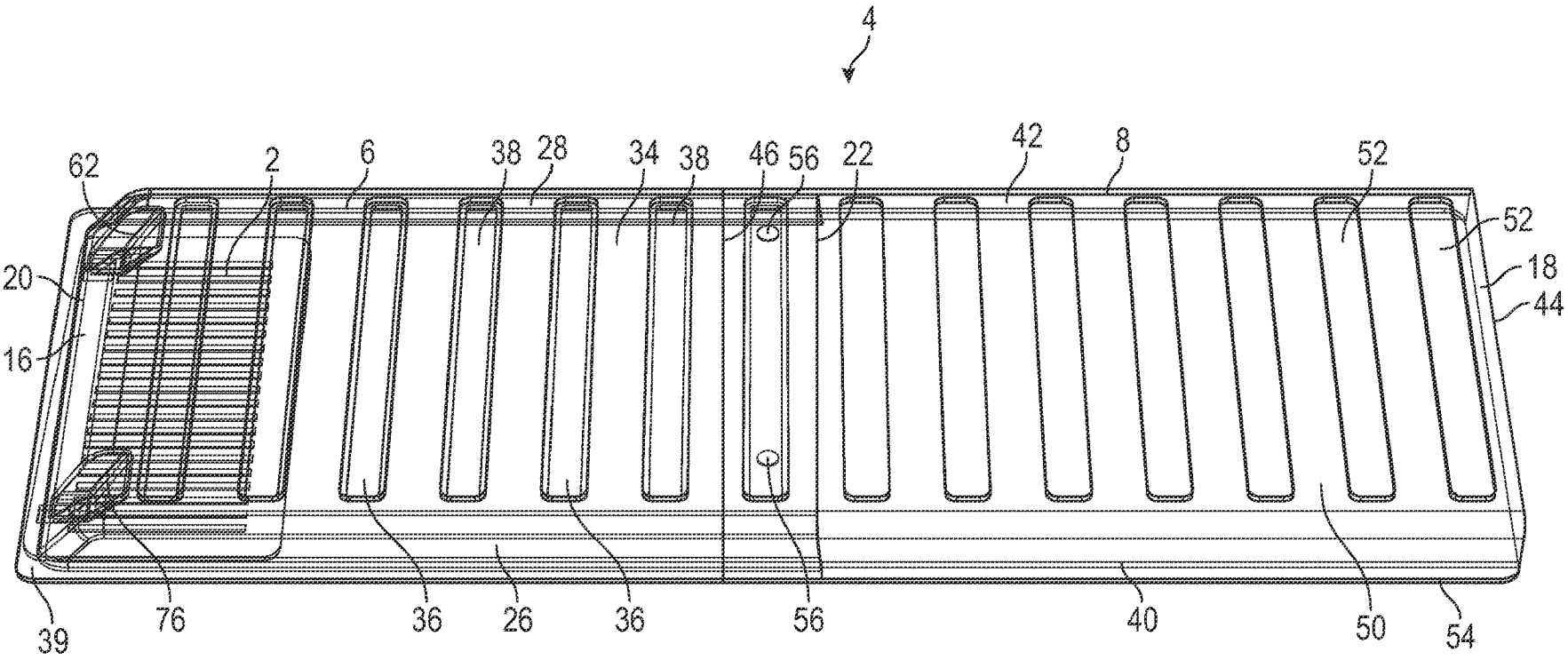
FIG. 1 is a first perspective view of a vent extender in an extended position coupled over a vent register.

Referring to FIG. 1, a first perspective view of a vent extender in an extended position coupled over a vent register is illustrated. As illustrated by FIG. 1, the implementations of the vent extenders disclosed herein are configured to be placed over a vent, vent grill, or vent register 2 and redirect the airflow coming from the vent. The implementations of the vent extenders disclosed herein may be configured to be positioned under furniture, such as a chair, couch, or bed, and redirect the air coming from the vent out from under the piece of furniture and into the living area of the room. The implementations of the vent extenders disclosed herein may reduce energy costs inasmuch as they may increase the efficiency of the distribution of the air throughout the living area of a room from the vent.

Figure 2:
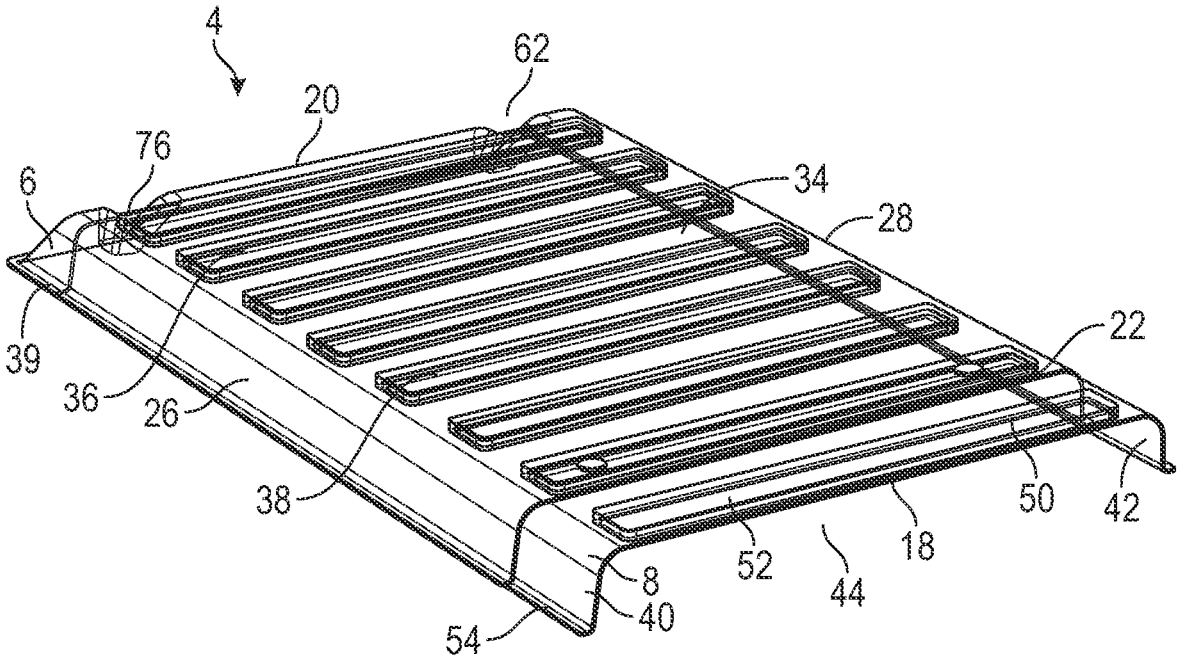
FIG. 2 is a perspective view of the vent extender of FIG. 1 in a retracted position.
Figure 3:
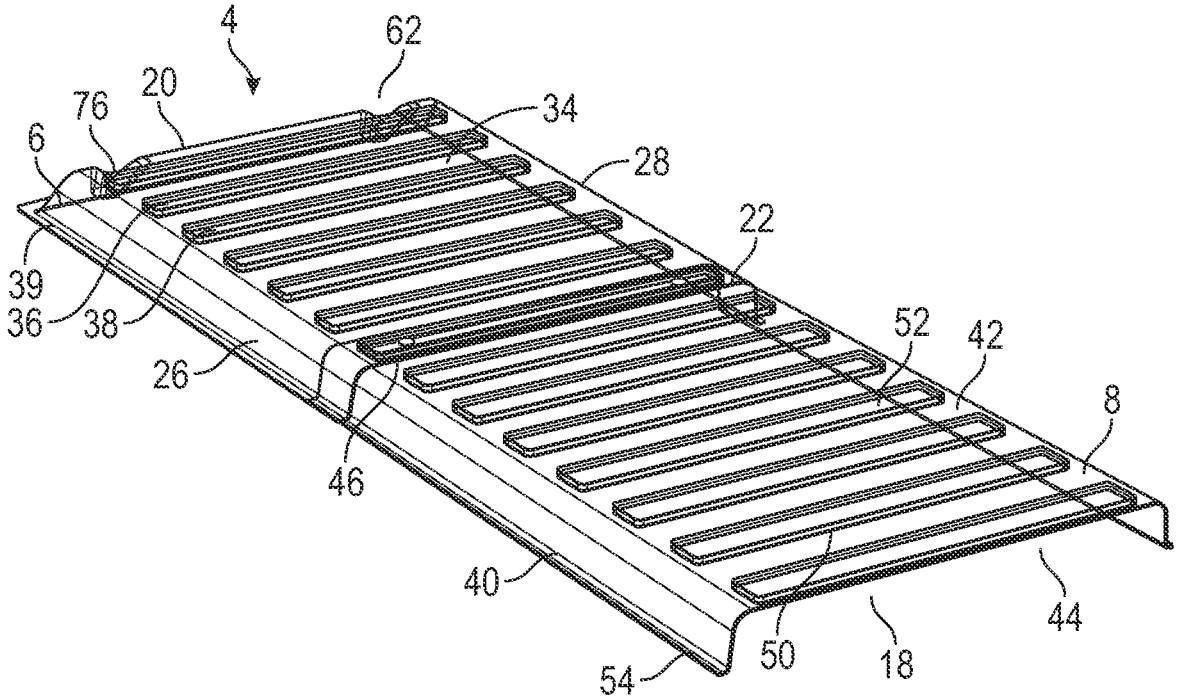
FIG. 3 is a second perspective view of the vent extender of FIG. 1 in an extended position.

Referring to FIG. 2, a perspective view of the vent extender of FIG. 1 in a retracted position is illustrated. Referring to FIG. 3, a second perspective view of the vent extender of FIG. 1 in an extended position is illustrated. As illustrated by FIGS. 1-3, the vent extender 4 includes a first portion 6 coupled to a second portion 8. In various implementations, and as illustrated by FIGS. 1-3, the vent extender 4, including the first portion 6 and/or the second portion 8 of the vent extender, may be transparent. In such implementations, the transparency of the first portion and/or second portion may minimize the visibility of the vent extender. In particular implementations, the first portion and/or second portion may be substantially entirely transparent or clear. In other implementations, the first portion and/or the second portion may be only partially transparent or clear. In particular implementations, the first portion and/or second portion may include a tint. The tint may be blue, black, or any other color.

Figure 7:
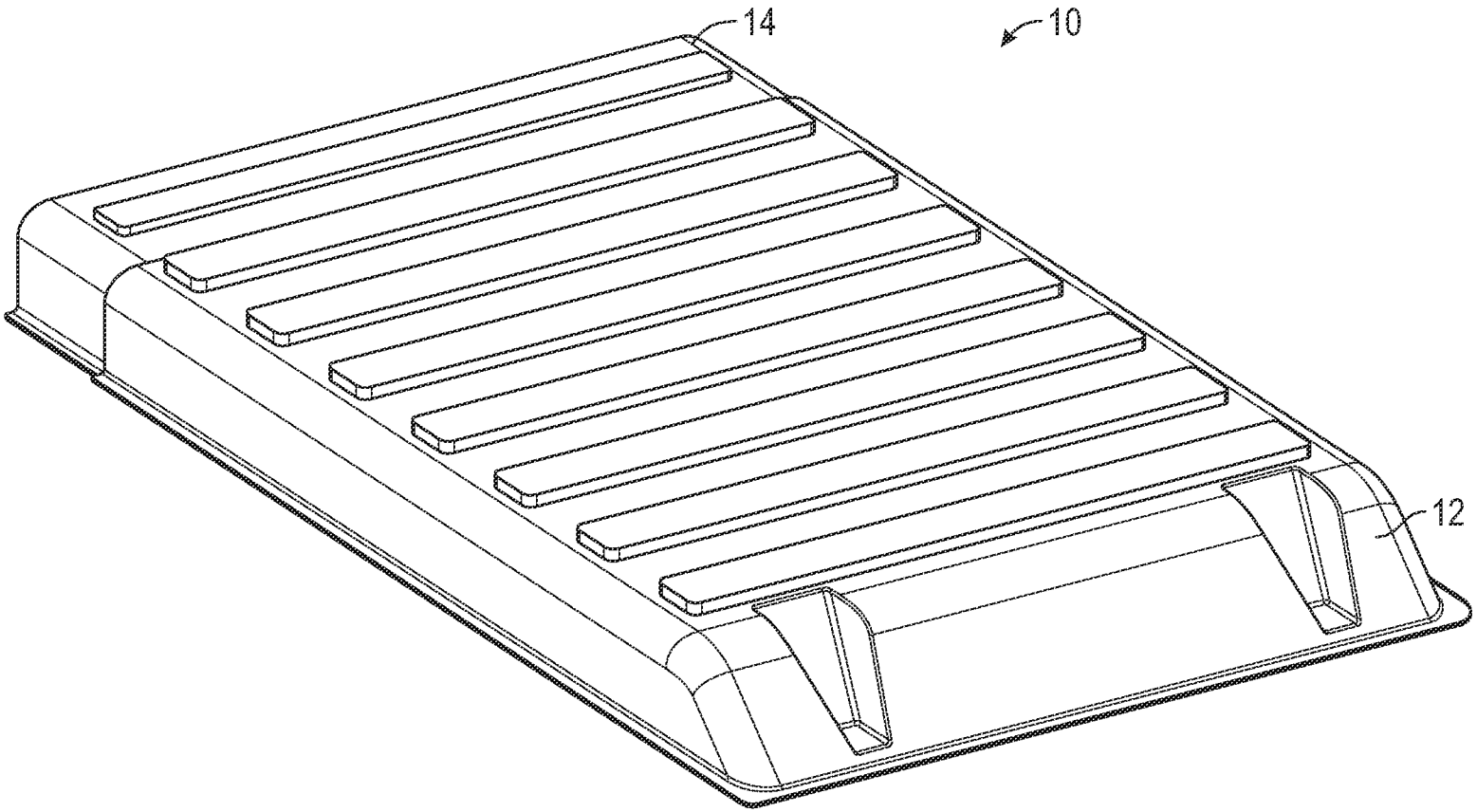
FIG. 7 is a perspective view of a second implementation of a vent extender in a retracted position.
Figure 8:
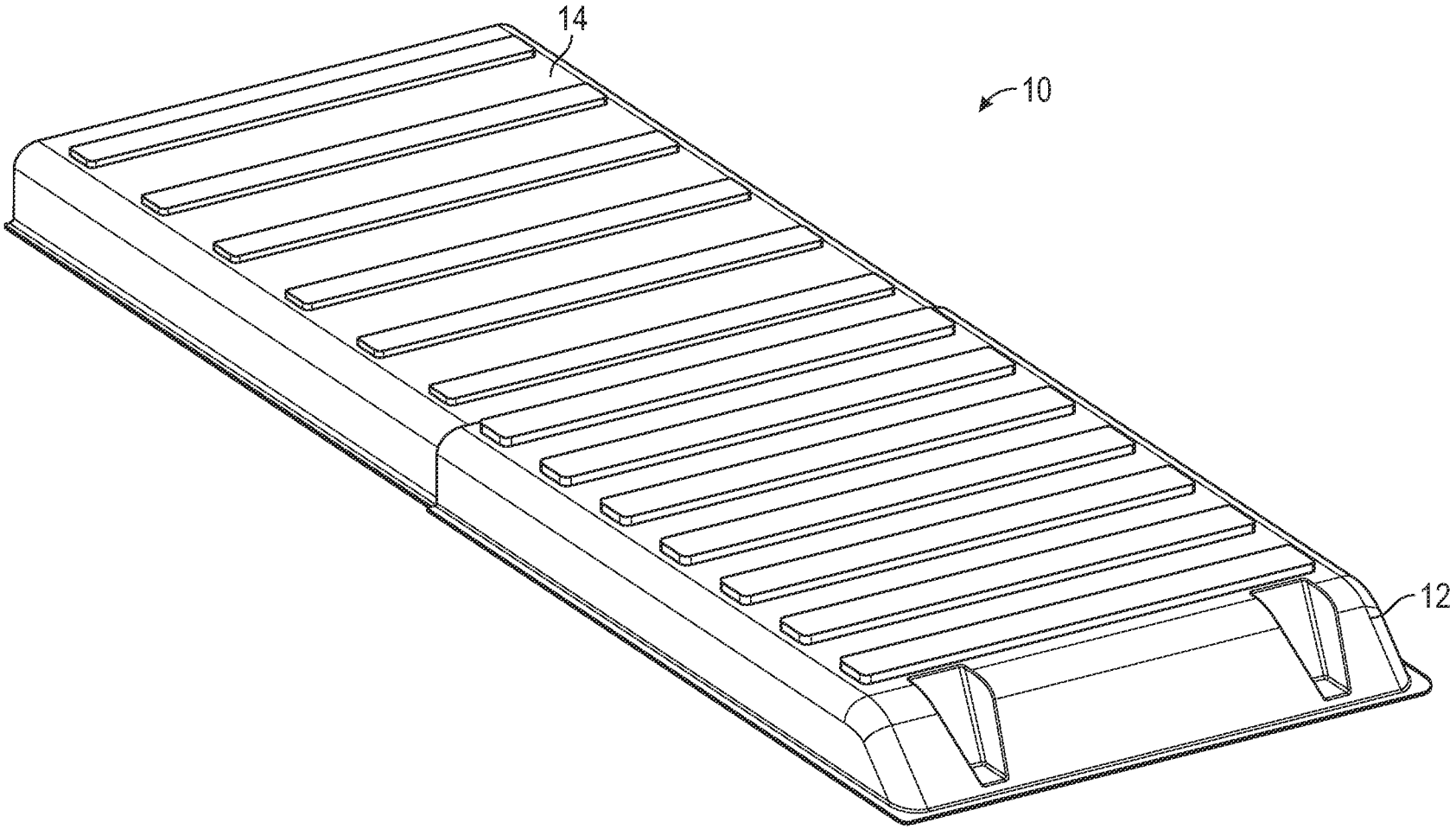
FIG. 8 is a perspective view of the vent extender of FIG. 7 in an extended position.
Figure 9:
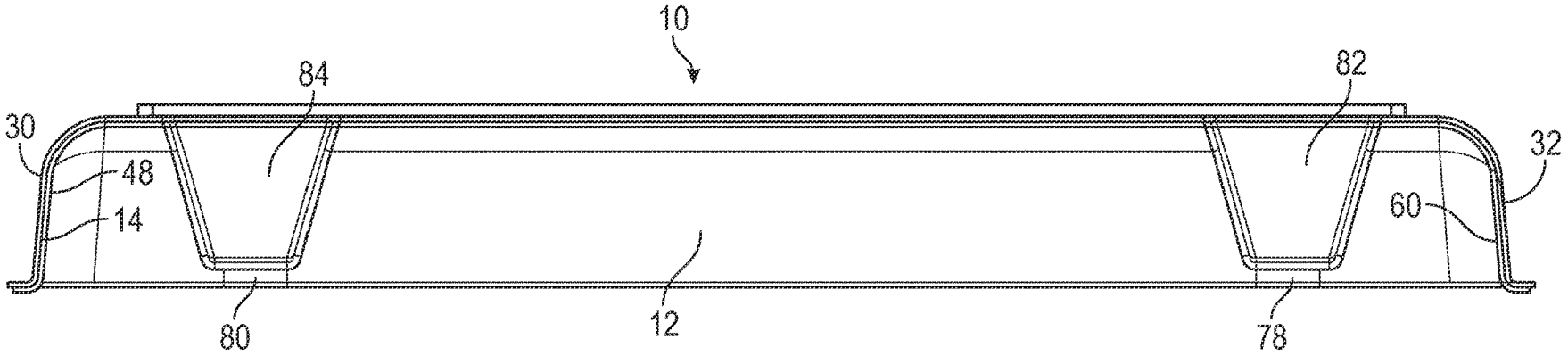
FIG. 9 is a front view of the vent extender of FIG. 8.
Figure 10:
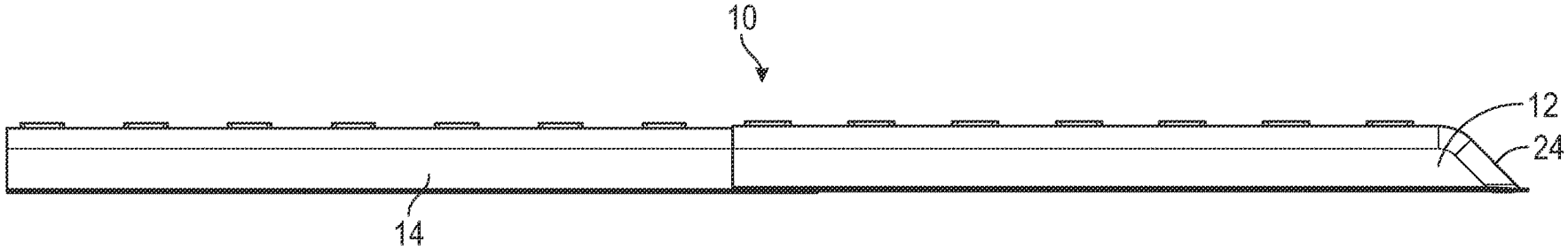
FIG. 10 is a side view of the vent extender of FIG. 8.

In other implementations, the vent extender, including the first portion and/or the second portion, may be opaque. Referring to FIG. 7 a perspective view of a second implementation of a vent extender in a retracted position is illustrated. Referring to FIG. 8, a perspective view of the vent extender of FIG. 7 in an extended position is illustrated. Referring to FIG. 9, a front view of the vent extender of FIG. 8 is illustrated. Referring to FIG. 10, a side view of the vent extender of FIG. 8 is illustrated. As illustrated by FIGS. 7-10, the vent extender 10 may be opaque. In such implementations, both the first portion 12 and the second portion 14 may be opaque. In other implementations, only one of the first portion or second portion may be opaque while the other portion is transparent. The implementation of the vent extender 4 of FIGS. 1-3 may be identical to the implementations of the vent extender 10 of FIGS. 7-10, with the exception that the vent extender of FIGS. 7-10 is opaque while the vent extender of FIGS. 1-3 is at least partially transparent.

Referring back to FIGS. 1-3, in various implementations, the vent extender 4, including the first portion 6 and/or the second portion 8 may be made from, by non-limiting example, a plastic, any other type of polymer, a paper-based material, a metal based material, or any other rigid or semi-rigid material capable of maintaining an opening to redirect airflow exiting a vent, vent grill, or vent register. In various implementations the thickness of the material forming the first portion 6 and/or the second portion 8 is 1 mm thick. In other implementations, the thickness of the material forming the first portion 6 and/or second portion 8 may be more than or less than 1 mm thick.

Still referring to FIGS. 1-3, the vent extender includes a front end 18 and a back end 20. As used herein, "front" refers to the end of the vent extender from which the redirected air exits the vent extender. As used herein, "back" or "rear" refer to the end of the vent extender opposite the front end. Accordingly, the airflow enters at the back end 20 of the vent extender 4 from the vent, travels through the vent extender towards the front end 18, and exits the front end.

The vent extender 4 includes a first portion 6. In various implementations, the first portion 6 includes a back wall 16. The back end 20 of the vent extender includes the back wall 16 of the first portion. In various implementations the back wall may be an inch high, more than an inch high, or less than an inch high. In various implementations, the back wall 16 may be sloped relative to the floor and towards the front end 22 of the first portion when the vent extender is placed on the floor. Referring to FIG. 10, the vent extender 10 clearly illustrates such a slope of the back wall 24. In other implementations, the back wall may be perpendicular to the floor when the vent extender is placed on the floor. The first portion 6 includes a front end 22 opposite the back wall 16. As illustrated by FIGS. 1-3, the front end 22 is open. In various implementations, the front end 22 may be entirely open or partially open. Because the front end is open, air entering the vent extender from the vent may exit the first portion 6 through the front end 22.

Still referring to FIGS. 1-3, the first portion 6 includes a first sidewall 26 and a second sidewall 28 coupled between the back wall 16 and the front end 22. In various implementations, either the first sidewall 26 and/or the second sidewall 28 may be sloped relative to the floor when the vent extender is placed on the floor. Referring to FIG. 9, the vent extender 10 clearly illustrates such a slope of the first sidewall 30 and the second sidewall 32. In other implementations, first sidewall 26 and/or the second sidewall 28 may be perpendicular to the floor when the vent extender is placed on the floor. In such implementations, the first sidewall may be parallel to the second sidewall. In other implementations, the first and second sidewalls may not be parallel.

In various implementations, the distance between the first sidewall 26 and the second sidewall 28 may remain the same as the sidewalls extend towards the front end 22. In other implementations, the distance between the first sidewall 26 and the second sidewall 28 may increase as the sidewalls extend towards the front end 22. In other implementations, the distance between the first sidewall 26 and the second sidewall 28 may decrease as the sidewalls extend towards the front end 22.

While the implementations disclosed herein illustrate a closed back wall, closed first sidewall, and closed second sidewall, in other implementations the first portion 6 may include openings in the back wall 16, the first sidewall 26, and/or the second sidewall 28. In still other implementations, first portion 6 may not include a back wall 16. In such implementations, air may be allowed to exit through any of the openings, including the opening at the front end as well as an opening at the back end. In such implementations, the vent extender may be configured to redirect air out of multiple openings of the vent extender, and in turn, may be configured to more evenly distribute the air throughout the room the vent extender is used in.

Still referring to FIGS. 1-3, the first portion 6 includes a roof 34. In various implementations, the roof may 34 be directly coupled to and between the first sidewall 26 and the second sidewall 28 and may be directly coupled to the back wall 16. The roof 34, in conjunction with the back wall and sidewalls, prevents air from leaving the vent extender 4 before the air reaches the front end 18 of the vent extender. In various implementations, the plane of the roof 34 may be parallel to the plane of the floor when the vent extender 4 is placed on the floor. In other implementations, the plane of the roof may be sloped relative to the plane of the floor when the vent extender is placed on the floor. In such implementations, the roof may slope upwards in a manner that results in the height of the front end being greater than the height of the back wall or may slope downwards in a manner that results in the height of the front end being less than the height of the back wall.

In various implementations, the roof 34 may include a plurality of projections 36 extending from the upper surface of the roof 34 when the vent extender 4 is placed over a vent register 2. In particular implementations, the plurality of projections may form a plurality of ridges 38 extending substantially across a width of the roof 34. In implementations of the roof 34 including a plurality of projections 36, the roof may include a plurality of recesses extending into the bottom surface of the roof corresponding to the projections extending from the upper surface of the roof. In other implementations, rather than a plurality of ridges 38 extending from the upper surface of the roof 34, the first portion 6 may include any other type of projection, including any other pattern or design such as a word or a logo, extending from the upper surface of the roof 34. In implementations having projections extending from the roof 34, the projections may reinforce the structure of the first portion. Further, the projections and/or recesses formed in the roof 34 of the first portion 6 may interlock with corresponding projections and/or recesses of a second portion 8 and secure the first portion 6 to the second portion 8.

In various implementations, the first portion 6 of the vent extender 4 may include a lip 39 extending from any of the back wall 16, the first sidewall 26 of the first portion, and/or the second sidewall 28 of the first portion. In other implementations, the first portion may not include a lip.

In various implementations, and as illustrated by FIGS. 1-3, the front end 22 of the first portion 6 may include a single opening. In other implementations, the channel through with the air flows through the vent extender 4 may be branched and the front end of the first portion 6 may include two or more openings.

In various implementations, the front end 22 of the first portion may also be the front end of the vent extender. In such implementations, the vent extender does not include a second portion 8 coupled to the first portion 6. In other implementations, and as illustrated by FIGS. 1-3, the vent extender 4 may include a second portion 8. In various implementations, the second portion 8 is configured to fit within or under the first portion 6. In other implementations, the second portion 8 is configured to fit over the first portion 6. As illustrated by FIGS. 1 and 3, the vent extender is in an extended position inasmuch as the majority of the second portion is extended from the first portion. Referring to FIG. 2, a perspective view of the vent extender of FIG. 1 in a retracted position is illustrated. In various implementations, the overall length of the vent extender 4 may be adjustable by adjusting the amount of the second portion 8 under or over the first portion 6. As illustrated by FIGS. 1-3, the second portion 8 includes a first sidewall 40 and a second sidewall 42. The second portion 8 is open at the front end 44 and the back end 46 of the second portion. In various implementations, either the first sidewall 26 and/or the second sidewall 28 may be sloped relative to the floor when the vent extender is placed on the floor. Referring to FIG. 9, the vent extender 10 clearly illustrates such a slope of the first sidewall 48 and the second sidewall 60. In other implementations, the first sidewall 40 and/or the second sidewall 42 may be perpendicular to the floor when the vent extender is placed on the floor. In such implementations, the first sidewall may be parallel to the second sidewall. In other implementations, the first and second sidewalls may not be parallel.

In various implementations, the distance between the first sidewall 40 and the second sidewall 42 may remain the same as the sidewalls extend to the front end 44. In other implementations, the distance between the first sidewall 40 and the second sidewall 42 may increase as the sidewalls near the front end 44. In other implementations, the distance between the first sidewall 40 and the second sidewall 42 may decrease as the sidewalls near the front end 44.

While the implementations disclosed herein illustrate a closed first sidewall and closed second sidewall, in other implementations the second portion 8 may include openings in the first sidewall 40 and/or the second sidewall 42. In such implementations, the vent extender may be configured to redirect air out of multiple openings of the vent extender, and in turn, may be configured to more evenly distribute the air throughout the room the vent extender is used in.

Still referring to FIGS. 1-3, the second portion 8 includes a roof 50. The roof 50 may be directly coupled to the first sidewall 40 and the second sidewall 42. The roof 50, in conjunction with the sidewalls, prevents air from leaving the vent extender 4 before the air reaches the front end 18 of the vent extender. In various implementations, the plane of the roof 50 may be parallel to the plane of the floor when the vent extender 4 is placed on the floor. In other implementations, the plane of the roof may be sloped relative to the plane of the floor when the vent extender is placed on the floor. In such implementations, the roof may slope upwards in a manner that results in the height of the front end 44 being greater than the height of the back end 46 or may slope downwards in a manner that results in the height of the front end being less than the height of the back end.

In various implementations, the roof 50 may include a plurality of projections 52 extending from the upper surface of the roof 50 when the vent extender 4 is placed over a vent register 2. In particular implementations, the plurality of projections may be the same as or similar to the plurality of projections 36 of the first portion 6. The roof 50 may include a plurality of recesses extending into the bottom surface of the roof corresponding to the projections extending from the upper surface of the roof. In implementations having projections 52 extending from the roof 50, the projections may reinforce the structure of the second portion 8. Further, the projections and/or recesses formed in the roof 50 of the second portion 8 may interlock with corresponding projections and/or recesses of the first portion 6 and secure the first portion 6 to the second portion 8. In such implementations, the size of the projections 52 may be configured to fit within the recesses of the first portion 6 (in implementations where the first portion 6 is coupled over the second portion 8), or the size of the projections 36 of the first portion 6 may be configured to fit within the recesses of the second portion 8 (in implementations where the second portion 8 is coupled over the first portion 6).

In various implementations, the second portion 8 of the vent extender 4 may include a lip 54 extending from the first sidewall 40 of the second portion 8 and/or the second sidewall 42 of the second portion 8. In other implementations, the second portion may not include a lip.

In various implementations, and as illustrated by FIGS. 1-3, the front end 44 of the second portion 8 may include a single opening. In other implementations, the channel through which the air flows through the vent extender 4 may be branched and the front end 44 of the second portion 8 may include two or more openings.

In various implementations, the width of the second portion 8 may be the same as the width of the first portion 6. In such implementations, the first portion 6 and/or the second portion 8 may be sufficiently flexible to allow the second portion 8 to fit within the first portion 6, or to allow the first portion 6 to fit within the second portion 8. In such implementations, the second portion 8 may be secured to the first portion 6 through a pressure fit between the first portion 6 and the second portion 8. In other implementations, the width of the first portion 6 may be slightly wider than the width of the second portion 8 to allow the second portion to fit within the first portion without requiring the first and/or the second portions to flex. In still other implementations, the width of the first portion 6 may be slightly narrower than the width of the second portion 8 to allow the first portion to fit within the second portion without requiring the first and/or the second portions to flex.

Figure 6:
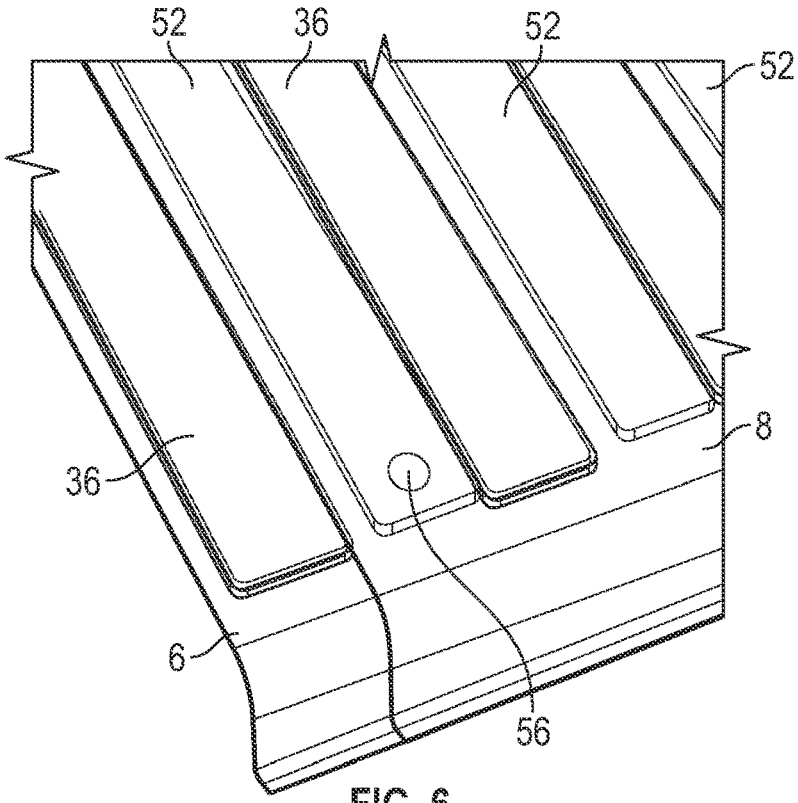
FIG. 6 is a magnified view of a coupling mechanism.

Referring to FIG. 1, the vent extender may include one or more coupling mechanisms 56 between the first portion 6 and the second portion 8. Referring to FIG. 6, a magnified view of a coupling mechanism 56 between a first portion 6 and a second portion 8 is illustrated. While FIG. 1 illustrates the coupling mechanisms as securing the first portion 6 to the second portion 8, FIG. 6 illustrates the coupling mechanism 56 fixed to the second portion 8 but not yet directly attached to the first portion 6. In various implementations, the coupling mechanisms may be fixedly attached to either the first portion 6 or the second portion 8. In other implementations, the coupling mechanism may include a first piece that is fixedly attached to the first portion and a second piece that is fixedly attached to the second portion. The first piece may be removably coupled to the second piece.

In various implementations, and as illustrated by FIG. 1, the coupling mechanisms 56 may be directly coupled within a recess of the second portion 8 and over the projection 36 of the first portion 6. In implementations where the second portion is coupled under the first portion, the coupling mechanism may be directly coupled over a projection 52 of the second portion and within a recess of the first portion. In still other implementations, the coupling mechanism may be directly coupled to any portion of any of the roof 34 of the first portion 6, the first sidewall 26 of the first portion, the second sidewall 28 of the first portion, the lip 39 of the first portion, the roof 50 of the second portion 8, the first sidewall 40 of the second portion, the second sidewall 42 of the second portion, the lip 54 of the second portion, or any combination thereof. In various implementations, the coupling mechanism may include, by non-limiting example, an adhesive (such as an adhesive dot), hook and loop fasteners, magnets, clips, or any other type of coupling mechanism.

The coupling mechanisms 56 may be configured to secure the first portion 6 to the second portion 8 with sufficient force to prevent the first portion from becoming separated from the second portion when the vent extender 4 is placed over a vent register 2. The coupling mechanisms 56 are also configured to allow a user to apply force to separate the first portion 6 from the second portion 8, adjust the length of the vent extender 4, and reattach the first portion to the second portion through the coupling mechanisms coupled between the first portion and the second portion.

While FIG. 1 illustrates the vent extender 4 as having two coupling mechanisms 56 coupled between the first portion 6 and the second portion 8, in other implementations the vent extender may include only a single coupling mechanism or more than two coupling mechanisms coupled between the first portion and the second portion of the vent extender.

While the implementations illustrated by FIGS. 1-3 illustrate the vent extender 4 in a fully extended position and a fully retracted position, it is understood that the vent extender may be extendable to any length between a fully retracted and a fully extended position. Further, in still other implementations the vent extender 4 may include greater extendability than the implementations disclosed herein and may include more portions than the first portion 6 and the second portion 8.

Figure 4:
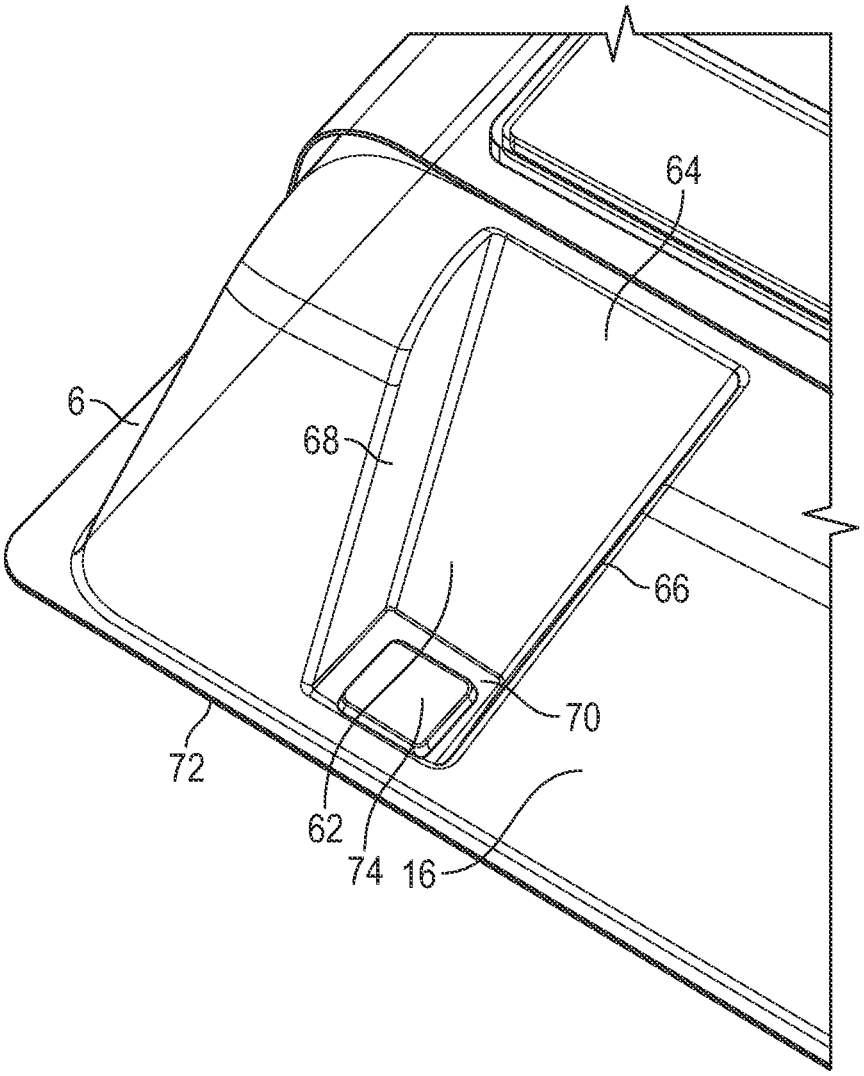
FIG. 4 is a magnified view of a pocket of the vent extender of FIG. 1.

Still referring to FIGS. 1-4, in various implementations the vent extender may include a first pocket 62 formed within the first portion 6. Referring to FIG. 4, a magnified view of a pocket of the vent extender of FIG. 1 is illustrated. In particular implementations, the first pocket 62 may be formed in the back wall 16 of the first portion 6. Referring to FIG. 4, in various implementations the first pocket 62 includes a first pocket sidewall 64, a second pocket sidewall 66, and a third pocket sidewall 68 opposite the second pocket sidewall. The first pocket sidewall 64 may be directly coupled to and between the second pocket sidewall 66 and the third pocket sidewall 68.

In various implementations the first pocket 62 includes an opening opposite the first pocket sidewall 64. In such implementations the first pocket sidewall may be exposed from the back end 20 of the vent extender. In such implementations, the first pocket 62 may include only three sidewalls. In other implementations, the pocket may include a fourth sidewall opposite the first sidewall.

In various implementations, the first pocket sidewall 64 may be sloped towards a front end 18 of the vent extender 4. In particular implementations, the slope of the first pocket sidewall 64 may be the same as the slope of the back wall 16. In turn, the first pocket sidewall 64 may be parallel to the back wall 16. In other implementations, the slope of the first pocket sidewall 64 may be different from the slope of the back wall 16, and in still other implementations, the first pocket sidewall 64 may not include a slope but may be perpendicular to the floor when the vent extender 4 is placed on the floor.

In various implementations, the slope of the second pocket sidewall 66 may be sloped towards the first sidewall 26 of the first portion 6. In other implementations, the slope of the second pocket sidewall 66 may be sloped away from the first sidewall 26 of the first portion 6, and in still other implementations the second pocket sidewall 66 may not include a slope when the vent extender 4 is placed on the floor. In various implementations, the slope of the third pocket sidewall 68 may be sloped towards the second sidewall 28 of the first portion 6. In other implementations, the slope of the third pocket sidewall 68 may be sloped away from the second sidewall 28 of the first portion 6, and in still other implementations the third pocket sidewall 68 may not include a slope when the vent extender 4 is placed on the floor. In particular implementations where the second pocket sidewall 66 and the third pocket sidewall 68 are sloped, the width of the first pocket 62 may taper towards the base 70 of the first pocket.

Figure 5:
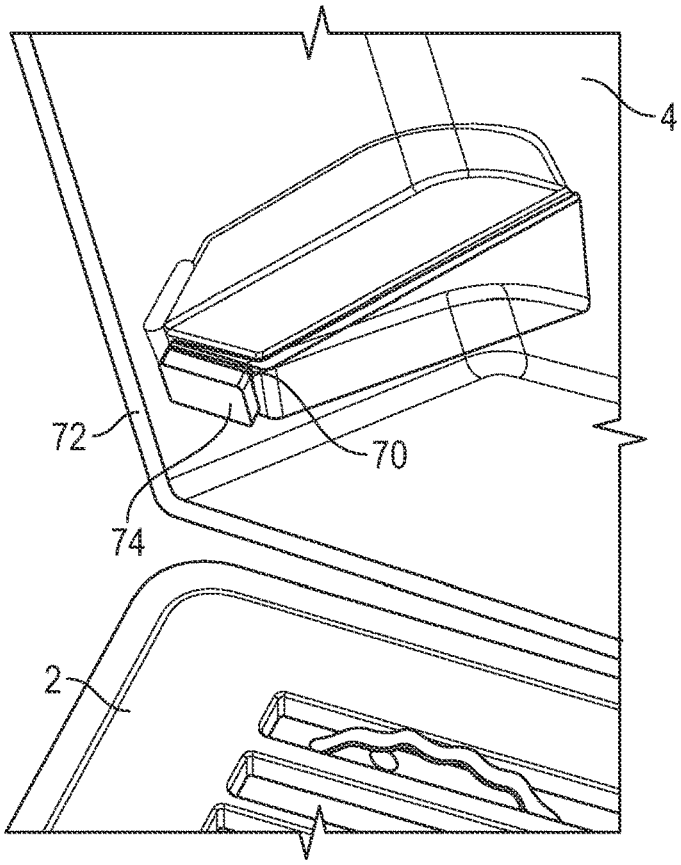
FIG. 5 is a magnified bottom view of a pocket of FIG. 1.

Still referring to FIG. 4, the first pocket 62 includes a base 70 at the bottom of the pocket and directly coupled to the first pocket sidewall 64, the second pocket sidewall 66, and the third pocket sidewall 68. Referring to FIG. 5, a magnified bottom view of a pocket of FIG. 1 is illustrated. In various implementations, and as illustrated by FIGS. 4-5, a first plane formed through the base 70 of the first pocket 62 may be closer to the roof 34 of the vent extender 4 than a second plane formed along a bottom 72 of the vent extender 4 opposite the roof of the vent extender. In such implementations, any coupling mechanism attached to the base may be configured to directly couple to the vent register while also allowing the bottom 72 of the vent extender 4 to lie flush with the floor.

Still referring to FIGS. 4-5, in various implementations the vent extender 4 includes a coupling mechanism 74 coupled to the base 70 of the first pocket 62. The coupling mechanism may include, by non-limiting example, an adhesive, hook and loop fasteners, a magnet, or any other type of coupling mechanism. In implementations including magnets, such as is illustrated by FIGS. 4-5, the magnet may be a neodymium magnet. The outer perimeter of the magnet may be circular, rectangular, or any other type of closed perimeter shape.

The coupling mechanism 74 is configured to secure the vent extender 4 to the vent register 2. In various implementations, the coupling mechanism 74 may be configured to directly couple to the vent register 2 and be between the vent register and the side of the base 70 facing the vent register when the vent extender 4 is fitted over the vent register. In other implementations where the coupling mechanism 74 is a magnet, the magnet may be directly coupled to a top surface of the base 70 within the first pocket 62. In such implementations, the base 70 may be configured to directly couple to the vent register 2 and be between the vent register and the magnet. The magnetic force between the magnet and the vent register 2 may extend through the base 70 and secure the vent extender 4 to the vent register 2.

In various implementations the coupling mechanism 74 may be attached to the base 70 through an adhesive. In other implementations the base 70 may include a pocket within the base that is configured to secure a coupling mechanism 74 therein through a pressure fit. In still other implementations, other coupling mechanisms could be used to secure the coupling mechanism 74 to the base 70.

In various implementations the vent extender may include only a single pocket. In such implementations, the width of the pocket may be similar to the width of the pockets illustrated by FIG. 1, while in other implementations the width of the pocket may be greater than the width of the pockets illustrated by FIG. 1. In particular implementations, the width of the pocket may extend nearly the entire width of the back wall of the first portion. In various implementations, the vent extender may include multiple coupling mechanisms coupled above or below the base of a single pocket.

In other implementations, and as illustrated by FIGS. 1-3, the vent extender may include a second pocket 76 formed within the first portion 6. The second pocket 76 may be identical to any implementation of the first pocket disclosed herein with the only difference being that the second pocket is located at a different portion of the first portion 6. More specifically, in particular implementations, the second pocket 76 may be formed in the back wall 16 of the first portion 6. In various implementations the second pocket 76 includes a first pocket sidewall, a second pocket sidewall, and a third pocket sidewall opposite the second pocket sidewall. The first pocket sidewall may be directly coupled to and between the second pocket sidewall and the third pocket sidewall.

In various implementations the second pocket 76 includes an opening opposite the first pocket sidewall. In such implementations the first pocket sidewall may be exposed from the back end 20 of the vent extender. In such implementations, the second pocket 76 may include only three sidewalls. In other implementations, the second pocket may include a fourth sidewall opposite the first sidewall.

In various implementations, the first pocket sidewall of the second pocket 76 may be sloped towards a front end 18 of the vent extender 4. In particular implementations, the slope of the first pocket sidewall may be the same as the slope of the back wall 16. In turn, the first pocket sidewall may be parallel to the back wall 16. In other implementations, the slope of the first pocket sidewall may be different from the slope of the back wall 16, and in still other implementations, the first pocket sidewall may not include a slope but may be perpendicular to the floor when the vent extender 4 is placed on the floor.

In various implementations, the slope of the second pocket sidewall of the second pocket 76 may be sloped towards the first sidewall 26 of the first portion 6. In other implementations, the slope of the second pocket sidewall may be sloped away from the first sidewall 26 of the first portion 6, and in still other implementations the second pocket sidewall may not include a slope when the vent extender 4 is placed on the floor. In various implementations, the slope of the third pocket sidewall may be sloped towards the second sidewall 28 of the first portion 6. In other implementations, the slope of the third pocket sidewall may be sloped away from the second sidewall 28 of the first portion 6, and in still other implementations the third pocket sidewall may not include a slope when the vent extender 4 is placed on the floor. In particular implementations where the second pocket sidewall and the third pocket sidewall are sloped, the width of the second pocket 76 may taper towards the base of the second pocket.

The second pocket 76 includes a base at the bottom of the pocket and directly coupled to the first pocket sidewall, the second pocket sidewall, and the third pocket sidewall. In various implementations, a first plane formed through the base of the second pocket 76 may be closer to the roof 34 of the vent extender 4 than a second plane formed along a bottom 72 of the vent extender 4 opposite the roof of the vent extender. In such implementations, any coupling mechanism attached to the base may be configured to directly couple to the vent register while also allowing the bottom 72 of the vent extender 4 to lie flush with the floor.

In various implementations the vent extender 4 includes a coupling mechanism coupled to the base of the second pocket 76. The coupling mechanism coupled to the base of the second pocket may be the same as any other coupling mechanism coupled to the base of the first pocket 62.

The coupling mechanism coupled to the base of the second pocket 76 is configured to secure the vent extender 4 to the vent register 2. In various implementations, the coupling mechanism may be configured to directly couple to the vent register 2 and be between the vent register and the side of the base facing the vent register when the vent extender 4 is fitted over the vent register. In other implementations where the coupling mechanism is a magnet, the magnet may be directly coupled to a top surface of the base within the second pocket 76. In such implementations, the base may be configured to directly couple to the vent register 2 and be between the vent register and the magnet. The magnetic force between the magnet and the vent register 2 may extend through the base and secure the vent extender 4 to the vent register 2.

In various implementations the coupling mechanism may be attached to the base through an adhesive. In other implementations the base may include a pocket within the base that is configured to secure a coupling mechanism therein through a pressure fit. In still other implementations, other coupling mechanisms could be used to secure the coupling mechanism to the base.

As illustrated by FIG. 1, the vent extender may include only the first pocket 62 and the second pocket 76, each pocket located next to an opposing corner of the back end of the vent extender. In other implementations, the vent extender may include two pockets located at different portions of the vent extender or may include more than two pockets. A similar implementation is illustrated by FIG. 9 which illustrates the vent extender 10 as only having a first pocket 82 and a second pocket 84 with a first magnet 78 coupled to the base of the first pocket and a second magnet 80 coupled to the base of the second pocket.

In other implementations, rather than the vent extender including a first pocket and/or a second pocket having a magnet coupled thereto, the vent extender may not include either of the first pocket or the second pocket but may include a platform formed as part of the first portion and configured to have a magnet or other coupling mechanism disclosed herein directly coupled thereto. In such implementations, the magnet or other coupling mechanism coupled to the platform may secure the vent extender to the vent register.

In various implementations, a kit may include any combination of a first portion of a vent extender, a second portion of a vent extender, one or more magnets configured to attach to a base of one or more pockets in the first portion, one or more adhesive tabs configured to attach to a base of one or more pockets in the first portion, and one or more coupling mechanisms configured to couple the first portion to the second portion. In such implementations, the kit may allow for a user to customize the vent extender by attaching magnets to the base of the one or more pockets to allow for the vent extender to be secured to a vent register that is attracted to magnets. The kit may also allow for a user to customize the vent extender by attaching adhesive tabs to the base of the one or more pockets to allow for the vent extender to be secured to a vent register that is not attracted to magnets.

In places where the description above refers to particular implementations of vent extenders and implementing components, sub-components, methods and sub-methods, it should be readily apparent that a number of modifications may be made without departing from the spirit thereof and that these implementations, implementing components, sub-components, methods and sub-methods may be applied to other vent extenders.

What is claimed is:

1. A vent extender comprising:

a first portion comprising a back wall, a first sidewall, and a second sidewall;

a second portion comprising a first sidewall and a second sidewall, the second portion configured to extendably couple to the first portion;

a first pocket formed within the back wall and comprising a first pocket sidewall, a second pocket sidewall, a third pocket sidewall opposite the second pocket sidewall, an opening opposite the first pocket sidewall, and a base;

a second pocket formed within the back wall and comprising a first pocket sidewall, a second pocket sidewall, a third pocket sidewall opposite the second pocket sidewall, an opening opposite the first pocket sidewall, and a base;

a first magnet coupled to the base of the first pocket; and a second magnet coupled to the base of the second pocket;

wherein the first magnet and the second magnets are configured to secure the vent extender to a vent register;

wherein the vent extender comprises only two pockets, including the first pocket and the second pocket, formed within the back wall; and wherein the second pocket sidewall and third pocket sidewall of each of the first pocket and the second pocket are substantially perpendicular to the back wall of the vent extender.

2. The vent extender of claim 1, wherein a width of the first pocket tapers towards the base of the first pocket and a width of the second pocket tapers towards the base of the second pocket.

3. The vent extender of claim 1, further comprising a roof directly coupled to and between the first sidewall of the first portion and the second sidewall of the first portion, wherein the roof comprises a plurality of ridges extending therefrom.

4. The vent extender of claim 1, wherein the first magnet and the second magnet are each configured to directly couple to the vent register.

5. The vent extender of claim 1, wherein the base of the first pocket is configured to be between the first magnet and the vent register and the base of the second pocket is configured to be between the second magnet and the vent register when the vent register is secured to the vent extender.

6. The vent extender of claim 1, wherein a first plane formed through the base of the first pocket and the base of the second pocket is closer to a roof of the vent extender than a second plane formed along a bottom of the vent extender opposite the roof of the vent extender.

7. The vent extender of claim 1, wherein the first magnet and the second magnet are neodymium magnets.

8. A vent extender comprising:

a first portion comprising a back wall, a first sidewall, a second sidewall, and a roof directly coupled to and between the first sidewall of the first portion and the second sidewall of the first portion;

a second portion comprising a first sidewall, a second sidewall, and a roof directly coupled to and between the first sidewall of the second portion and the second sidewall of the second portion;

one or more coupling mechanisms configured to extendably couple the first portion to the second portion;

a first pocket formed within the first portion and comprising a first pocket sidewall, a second pocket sidewall, a third pocket sidewall opposite the second pocket sidewall, an opening opposite the first pocket sidewall, and a base;

a second pocket formed within the first portion and comprising a first pocket sidewall, a second pocket sidewall, a third pocket sidewall opposite the second pocket sidewall, an opening opposite the first pocket sidewall, and a base;

a first magnet coupled to the base of the first pocket; and a second magnet coupled to the base of the second pocket;

wherein the roof of the first portion comprises a plurality of ridges extending therefrom;

wherein the roof the second portion comprises a plurality of ridges extending therefrom;

wherein the first portion comprises only two pockets two pockets including the first pocket and the second pocket;

wherein the second pocket sidewall and the third pocket sidewall of each of the first pocket and second pocket are substantially perpendicular to the back wall; and wherein the first magnet and the second magnets are configured to secure the vent extender to a vent register.

9. The vent extender of claim 8, wherein the first portion and the second portion are transparent.

10. The vent extender of claim 8, wherein the plurality of ridges of the roof of the first portion are configured to interlock with the plurality of ridges of the roof of the second portion.

11. The vent extender of claim 8, wherein each of the first pocket and the second pocket comprise less than four sidewalls.

12. The vent extender of claim 8, wherein the first sidewall of the first pocket and the second pocket slopes towards a front of the vent extender, the second sidewall of the first pocket and the second pocket slopes towards the first sidewall of the first portion, and the third sidewall of the first pocket and the second pocket slopes towards the second sidewall of the first portion.

* * * * *